US010164307B2

(12) United States Patent
Gomi et al.

(10) Patent No.: US 10,164,307 B2
(45) Date of Patent: Dec. 25, 2018

(54) WAVEGUIDE BEND FORMED IN A METAL BLOCK AND COUPLED TO A BOARD UNIT TO FORM A WIRELESS DEVICE

(71) Applicant: KABUSHIKI KAISHA TOSHIBA, Minato-ku, Tokyo (JP)

(72) Inventors: Koichiro Gomi, Kanagawa (JP); Tooru Kijima, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 58 days.

(21) Appl. No.: 15/213,672

(22) Filed: Jul. 19, 2016

(65) Prior Publication Data

US 2017/0025726 A1 Jan. 26, 2017

(30) Foreign Application Priority Data

Jul. 23, 2015 (JP) ..... 2015-146140

(51) Int. Cl.

| | |
|---|---|
| ***H01P 1/02*** | (2006.01) |
| ***H01P 5/02*** | (2006.01) |
| ***H01P 5/107*** | (2006.01) |
| *H01Q 19/13* | (2006.01) |

(52) U.S. Cl.

CPC ..... *H01P 1/022* (2013.01); *H01P 1/025* (2013.01); *H01P 1/027* (2013.01); *H01P 5/024* (2013.01); *H01P 5/107* (2013.01); *H01Q 19/132* (2013.01)

(58) Field of Classification Search

CPC .. H01P 1/02; H01P 1/022; H01P 1/025; H01P 1/027; H01P 5/024

USPC ..... 333/249, 34

See application file for complete search history.

(56) References Cited

U.S. PATENT DOCUMENTS

| | | | | |
|---|---|---|---|---|
| 5,311,154 A * | 5/1994 | Hirota | H01P 5/107 | 333/249 |
| 5,886,588 A * | 3/1999 | Schneider | H01P 5/082 | 333/21 R |
| 6,552,636 B1 * | 4/2003 | Yuanzhu | H01P 1/02 | 333/21 A |
| 7,420,434 B2 * | 9/2008 | Hoover | H01P 1/02 | 333/21 R |

(Continued)

FOREIGN PATENT DOCUMENTS

| | | |
|---|---|---|
| JP | 2005020077 A | 1/2005 |
| JP | 4825250 B2 | 11/2011 |

OTHER PUBLICATIONS

Yamane, et al., "Studies on the Characterization and Optimal Design of E-Plane Waveguide Bends", Technical Report of IEICE, MW96-138, Dec. 1996, p. 37-42, with English Abstract.

*Primary Examiner* — Benny Lee

(74) *Attorney, Agent, or Firm* — Holtz, Holtz & Volek PC

(57) ABSTRACT

According to one embodiment, a waveguide bend includes a metal block. The metal block includes a first waveguide, a second waveguide and a third waveguide. The first waveguide, the second waveguide and the third waveguide are integrally formed. The second waveguide includes a bend at which a propagation direction of a radio wave is changed. An opening size of the second waveguide is smaller than an opening size of the first waveguide. The third waveguide is provided between the first waveguide and the second waveguide. An opening size of the third waveguide is smaller than the opening size of the first waveguide and is larger than the opening size of the second waveguide.

13 Claims, 8 Drawing Sheets

(56) References Cited

U.S. PATENT DOCUMENTS

| | | | | |
|---|---|---|---|---|
| 8,173,943 | B2 * | 5/2012 | Ristola et al. ..... | H01P 5/024<br>219/690 |
| 2004/0227597 | A1 * | 11/2004 | Chang et al. ..... | H01P 1/022<br>333/249 |
| 2008/0303612 | A1 * | 12/2008 | Chen et al. ..... | H01P 1/025<br>333/248 |

* cited by examiner

WAVEGUIDE BEND FORMED IN A METAL BLOCK AND COUPLED TO A BOARD UNIT TO FORM A WIRELESS DEVICE

CROSS-REFERENCE TO RELATED APPLICATION

This application is based upon and claims the benefit of priority from Japanese Patent Application No. 2015-146140, filed Jul. 23, 2015; the entire contents of which are incorporated herein by reference.

FIELD

Embodiments described herein relate generally to a waveguide bend and a wireless device.

BACKGROUND

A waveguide bend used in a high-frequency transmission line has been known. The waveguide bend includes a bend which changes a propagation direction of a radio wave.

The waveguide bend is generally manufactured by assembling a plurality of metal pieces. In some cases where the plurality of metal pieces is assembled, an assembling operation may be complicated, and thus, it may be difficult to improve manufacturability.

If a tube width of a part of the waveguide bend is set to be narrow in order to reduce an undesired wave, to reduce thermal noise, or to achieve another purpose, it may be difficult to achieve impedance matching. If a sectional shape of the waveguide bend has manufacturing limitations, it may be difficult to achieve impedance matching in some cases.

DETAILED DESCRIPTION OF THE INVENTION

Figure 1:
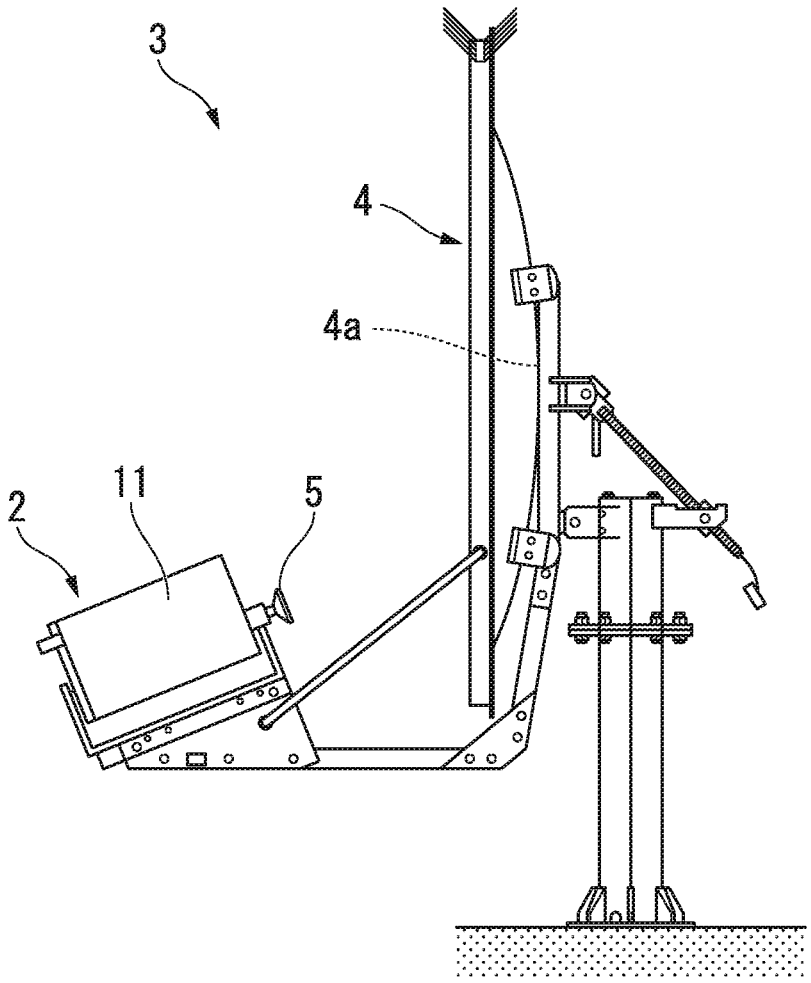
FIG. 1 is a side view showing an example of a wireless device according to a first embodiment.

According to one embodiment, a waveguide bend includes a metal block. The metal block includes a first waveguide, a second waveguide and a third waveguide. The first waveguide, the second waveguide and the third waveguide are integrally formed. The second waveguide includes a bend which changes a propagation direction of a radio wave. An opening size of the second waveguide is smaller than an opening size of the first waveguide. The third waveguide is provided between the first waveguide and the second waveguide. An opening size of the third waveguide is smaller than the opening size of the first waveguide and is larger than the opening size of the second waveguide.

Hereinafter, a waveguide bend and a wireless device according to embodiments will be described with reference to the drawings. In the following description, the configurations having the same or similar functions will be assigned the same reference numerals. The redundant description thereof may be omitted.

(First Embodiment)

A waveguide bend 1 and a wireless device 2 according to a first embodiment will be described with reference to FIGS. 1 to 7.

FIG. 1 shows an example of the wireless device 2.

The wireless device 2 according to the present embodiment is, for example, a wireless device constituting a part of a satellite communication outdoor unit 3. For example, the wireless device 2 is used in a satellite communication system such as a very-small-aperture terminal (VSAT). For example, the wireless device 2 transmits and receives a radio wave of a millimeter wave band or a microwave band such as a Ku band (12 GHz to 18 GHz).

As shown in FIG. 1, the satellite communication outdoor unit 3 includes a reflector 4. The reflector 4 includes a curved reflection surface 4*a*. The wireless device 2 is disposed in front of the reflector 4. The wireless device 2 includes a primary horn 5 facing the reflection surface 4*a* of the reflector 4. The wireless device 2 emits a radio wave toward the reflector 4 through the primary horn 5. The wireless device 2 receives a radio wave from the outside, which is reflected from the reflector 4, through the primary horn 5.

The configuration of the present embodiment is not limited to the satellite communication device, and is widely applicable to various wireless devices.

Figure 2:
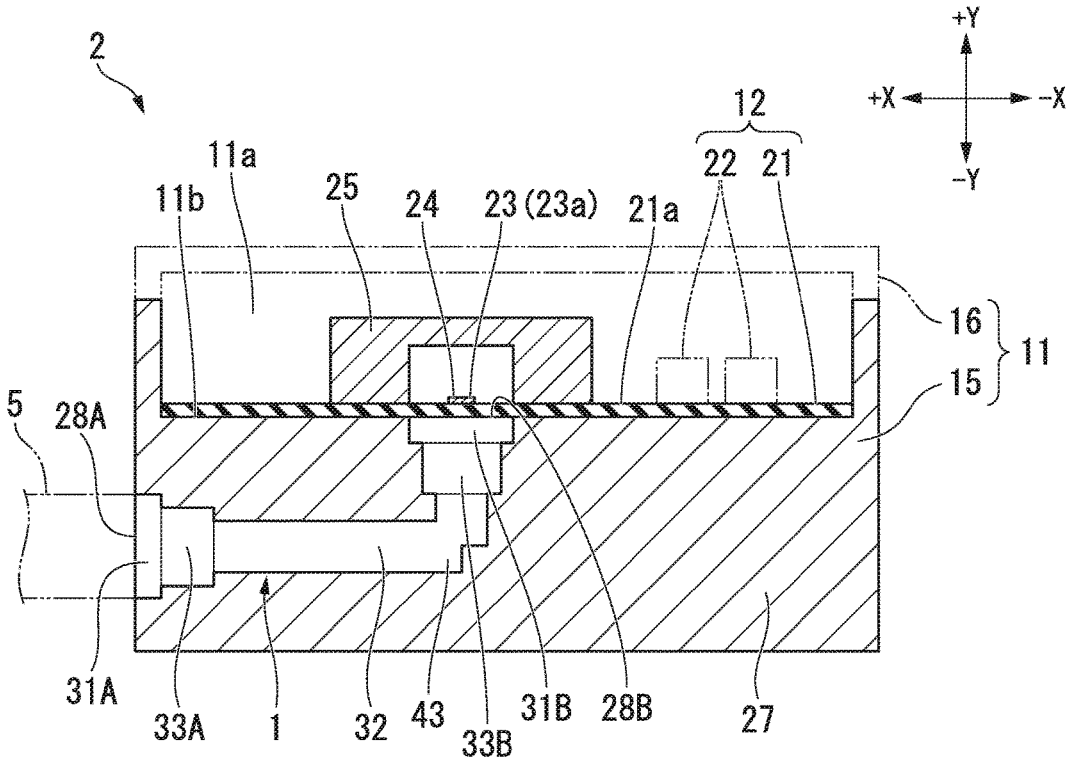
FIG. 2 is a sectional view showing the wireless device shown in FIG. 1.

FIG. 2 is a sectional view of the wireless device 2.

As shown in FIG. 2, the wireless device 2 includes a housing 11, and a board unit (e.g., wireless module) 12 accommodated in the housing 11.

The housing 11 includes a housing case 15, and a housing cover 16 combined with the housing case 15. The housing case 15 and the housing cover 16 are made from metal. The housing case 15 and the housing cover 16 are combined with each other, and thus, a box-shaped housing 11 is formed. A storage (e.g., storage space) 11*a* that accommodates the board unit 12 is formed between the housing case 15 and the housing cover 16. The housing case 15 includes a mounting surface 11*b* on which the board unit 12 is mounted.

The board unit 12 includes a circuit board (e.g., printed circuit board) 21, and a plurality of electronic components 22 mounted on a surface 21*a* (e.g., component mounting surface) of the circuit board 21. The plurality of electronic components 22 includes a high-frequency component constituting at least a part of a wireless circuit. The circuit board 21 includes a microstrip line 23 for radio signal transmission. The microstrip line 23 is a part of a wiring pattern of the circuit board 21. An electric signal flows through the microstrip line 23. The electric signal is to be converted into a radio wave which passes through the waveguide bend 1. The microstrip line 23 is an example of the "circuit configured to supply a radio wave to the waveguide bend".

Figure 3:
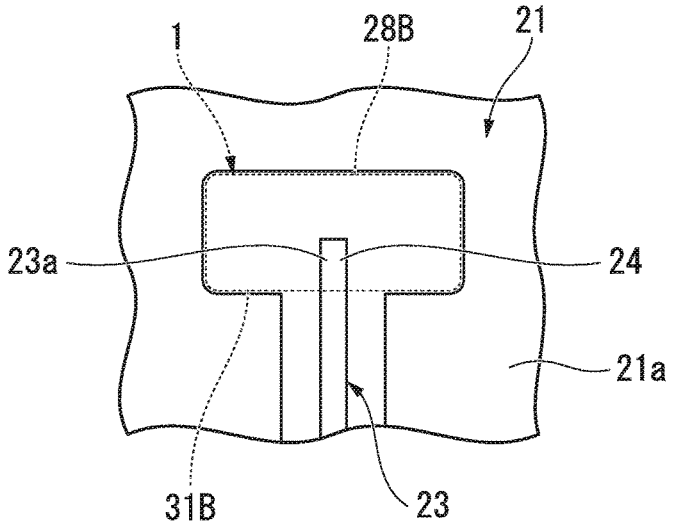
FIG. 3 is a plan view showing a circuit board shown in FIG. 2.

FIG. 3 is a plan view which shows the microstrip line 23.

As shown in FIG. 3, an end 23*a* of the microstrip line 23 faces a second opening 28B of the waveguide bend 1, to be described below, in a thickness direction of the circuit board 21. The end 23*a* of the microstrip line 23 forms a conversion circuit 24, which converts a signal between the microstrip line 23 and the waveguide bend 1, as a probe. The conversion circuit 24 converts electric signals flowing through the microstrip line 23 into a radio wave for the waveguide, and sends the converted radio wave toward the waveguide bend 1, to be described below. The conversion circuit 24 converts a radio wave received from the waveguide bend 1 into electric signals flowing into the microstrip line 23.

As shown in FIG. 2, a back short metal cover 25 is attached to the circuit board 21. The metal cover 25 covers the end 23*a* of the microstrip line 23 from a side opposite to the waveguide bend 1.

Next, the waveguide bend 1 provided at the housing case 15 will be described.

As shown in FIG. 2, in the present embodiment, the waveguide bend 1 and the housing case 15 are integrally formed. That is, the waveguide bend 1 is directly provided at a metal block 27 which forms at least a part of the housing 11. The metal block 27 is made from, for example, an aluminum alloy, but is not limited thereto.

Here, for the sake of convenience in the description, a +X direction, a −X direction, a +Y direction and a −Y direction are defined as shown in FIG. 2. The +X direction is a direction which is substantially parallel to the surface (e.g., component mounting surface) 21*a* of the circuit board 21, and is a direction extending from the waveguide bend 1 toward the primary horn 5. The −X direction is a direction opposite to the +X direction. The +Y direction is a direction which crosses (e.g., substantially perpendicular to) the +X direction. For example, the +Y direction is a thickness direction of the circuit board 21, and is a direction extending from the waveguide bend 1 toward the circuit board 21. The −Y direction is a direction opposite to the +Y direction.

As shown in FIG. 2, the waveguide bend 1 has a first opening 28A and the second opening 28B. The first opening 28A is open to the outside of the housing 11 in the +X direction. The primary horn 5 is attached to the first opening 28A. Meanwhile, the second opening 28B is open within the housing 11 in the +Y direction. The second opening 28B is open in the mounting surface 11*b*. The second opening 28B faces the conversion circuit 24 of the circuit board 21 in the +Y direction. The radio wave propagating along the −X direction from the primary horn 5 enters the waveguide bend 1. The waveguide bend 1 changes a propagation direction of the radio wave propagating along the −X direction from the primary horn 5 toward the +Y direction. The radio wave propagating along the −Y direction from the conversion circuit 24 of the circuit board 21 enters the waveguide bend 1. The waveguide bend 1 changes a propagation direction of the radio wave along the −Y direction from the conversion circuit 24 toward the +X direction.

Hereinafter, the shapes of the respective portions of the waveguide bend 1 will be described in detail.

Figure 4:
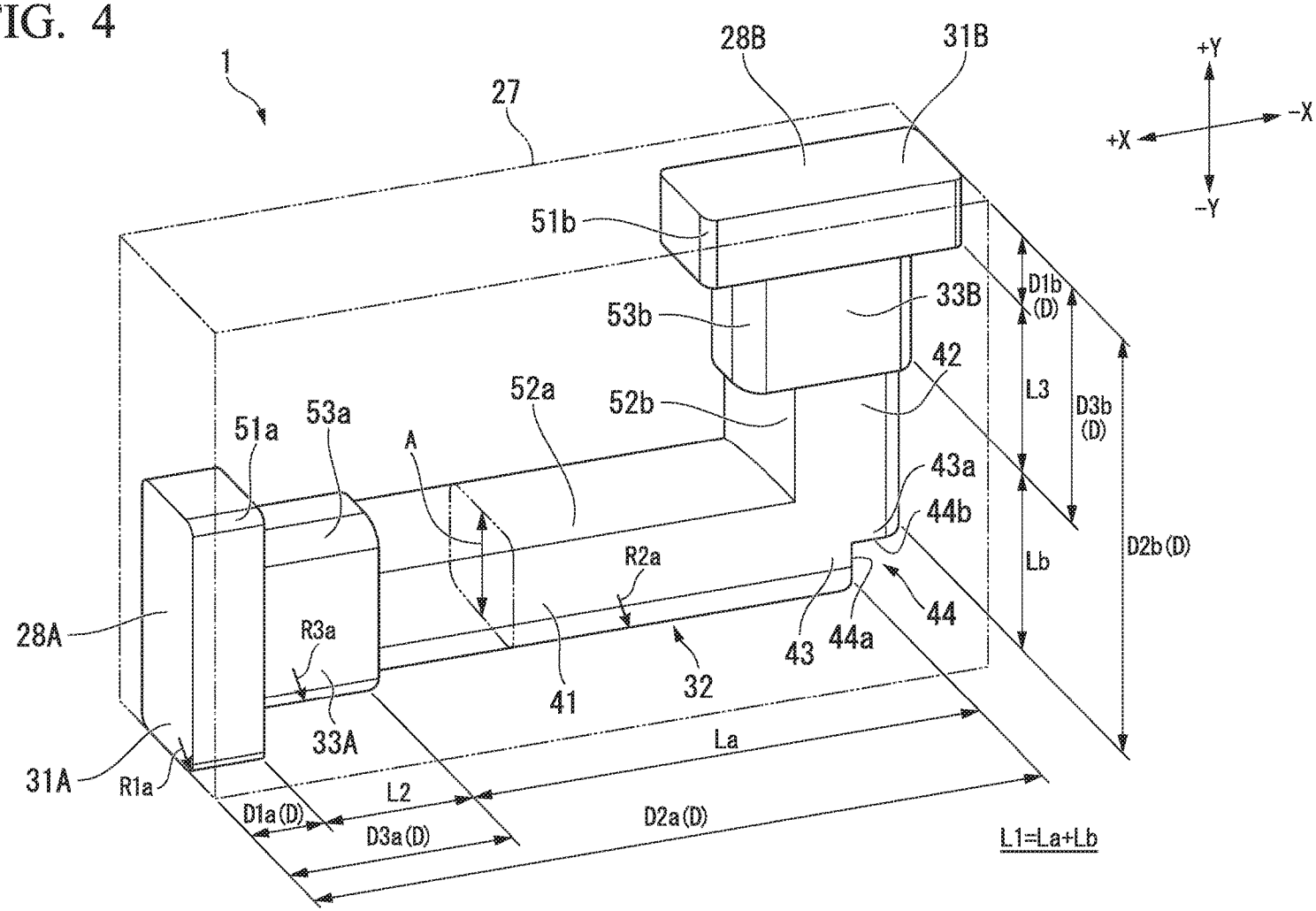
FIG. 4 is a perspective view showing a waveguide bend shown in FIG. 2.

FIG. 4 shows portions related to the waveguide bend 1 extracted from the metal block 27. In FIG. 4, for the sake of convenience in the description, a hollow of the waveguide bend 1 is shown.

As shown in FIG. 4, the waveguide bend 1 includes a pair of standard waveguides 31A and 31B, a bend waveguide 32, and a pair of matching waveguides 33A and 33B.

Initially, the standard waveguides 31A and 31B will be described.

Each of the pair of standard waveguides 31A and 31B is an example of a "first waveguide". The pair of standard waveguides 31A and 31B is provided so as to be divided at both ends of the waveguide bend 1 in the propagation direction of the radio wave. In other words, each of the standard waveguide 31A and the standard wave guide 31B is provided at a respective end of the bend waveguide 32, to be described below, in the propagation direction of the radio wave. The standard waveguides 31A and 31B serve as input and output interfaces of the waveguide bend 1. The opening sizes of the standard waveguides 31A and 31B are sizes standardized depending on the frequency band of a passband set to the waveguide bend 1. Hereinafter, for the sake of convenience in the description, one standard waveguide 31A is referred to as a "first standard waveguide 31A", and the other standard waveguide 31B is referred to as a "second standard waveguide 31B".

As shown in FIG. 4, the first standard waveguide 31A is provided at one end of the waveguide bend 1 and extends along the +X direction. An end of the first standard waveguide 31A in the +X direction forms the first opening 28A. Meanwhile, the second standard waveguide 31B is provided at the other end of the waveguide bend 1 and extends along the +Y direction. An end of the second standard waveguide 31B in the +Y direction forms the second opening 28B.

The opening size of the first standard waveguide 31A and the opening size of the second standard waveguide 31B are substantially the same. In the propagation direction of the radio wave, the length of the first standard waveguide 31A and the length of the second standard waveguide 31B may be different from each other.

Next, the bend waveguide 32 will be described.

The bend waveguide 32 is an example of a "second waveguide". The bend waveguide 32 is provided at a portion where a central axis intersecting a center of the first standard waveguide 31A along the −X direction and a central axis intersecting a center of the second standard waveguide 31B along the −Y direction cross each other.

As shown in FIG. 4, the bend waveguide 32 according to the present embodiment includes a first straight portion 41, a second straight portion 42 extending in a direction different from the first straight portion 41, and a bend 43 which is a connector of the first straight portion 41 and the second straight portion 42.

As shown in FIG. 4, the first straight portion 41 is provided substantially in parallel with the first standard waveguide 31A, and extends along the +X direction. The first straight portion 41 is provided between the first standard waveguide 31A and the bend 43.

Meanwhile, the second straight portion 42 is provided substantially in parallel with the second standard waveguide 31B, and extends along the +Y direction. The second straight portion 42 is provided between the second standard waveguide 31B and the bend 43.

The bend 43 is provided between the first straight portion 41 and the second straight portion 42, and connects the first straight portion 41 and the second straight portion 42. The bend 43 changes the propagation direction of the radio wave propagating in the bend waveguide 32. In the present embodiment, the bend 43 is bent at substantially 90 degrees. That is, the bend 43 according to the present embodiment changes the propagation direction of the radio wave at substantially 90 degrees. The bent angle of the bend 43 may be an angle greater than 90 degrees, or may be an angle less than 90 degrees.

As shown in FIG. 4, a one-stepped recess 44 is formed at a corner 43*a* of the bend 43. The corner 43*a* of the bend 43 is a corner on the −X direction side and on the −Y direction side. The recess 44 is a matching element that reduces impedance mismatching at the bend 43. The recess 44 is formed, and thus, it is also possible to achieve the broadband of the bend 43.

Figure 5:
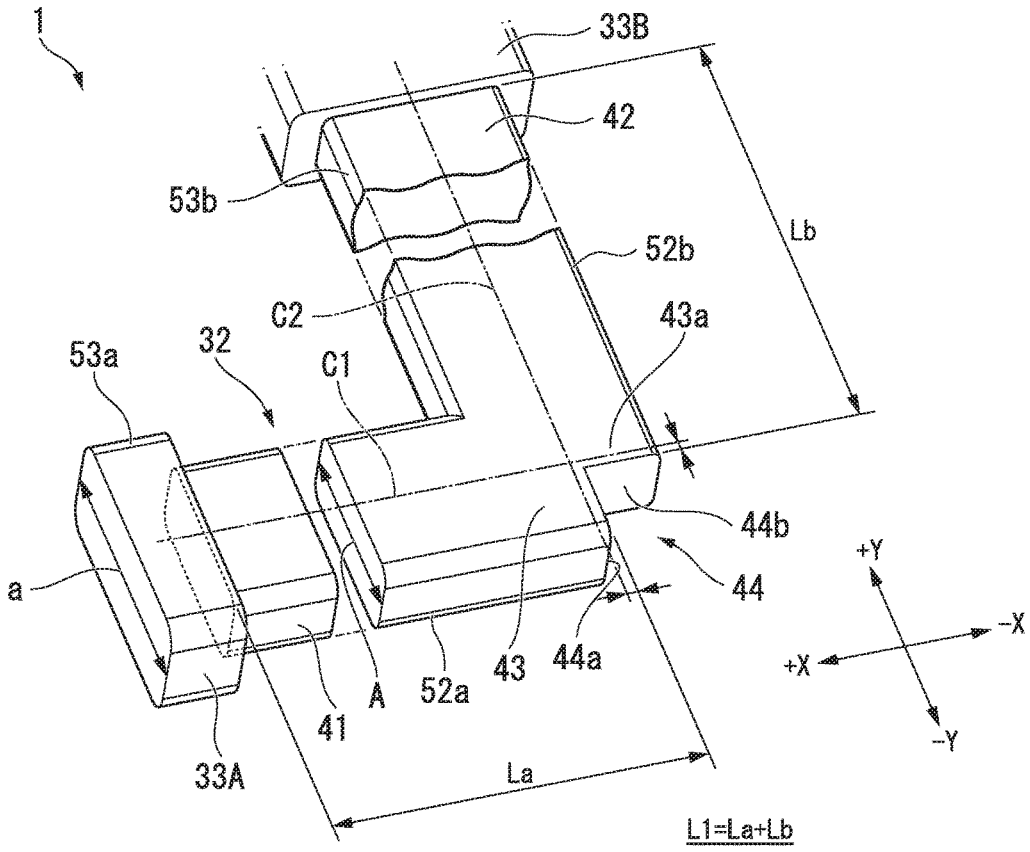
FIG. 5 is an enlarged perspective view of a bend of the waveguide bend shown in FIG. 4.

FIG. 5 is an enlarged view of the bend 43.

As shown in FIG. 5, the recess 44 includes a first surface 44*a* and a second surface 44*b*.

The first surface 44*a* is an end surface along the +Y direction. The first surface 44*a* is provided in a position which is recessed from a part (e.g., an end in the −X direction) of the second straight portion 42 toward the +X direction.

Meanwhile, the second surface 44*b* is an end surface along the +X direction. The second surface 44*b* is provided in a position recessed from a part (e.g., an end in the −Y direction) of the first straight portion 41 toward the +Y direction.

Here, the first straight portion 41 has a central axis (e.g., tube axis) C1 as a central axis of the first straight portion 41. The central axis C1 extends along the +X direction and passes through a center in the +Y direction of the first straight portion 41. Similarly, the second straight portion 42 has a central axis (e.g., tube axis) C2 as a central axis of the second straight portion 42. The central axis C2 extends along the +Y direction and passes through a center in the +X direction of the second straight portion 42.

As shown in FIG. 5, the first surface 44*a* of the recess 44 is formed so as to be offset with respect to the central axis C2 of the second straight portion 42 by a predetermined amount (i.e., predetermined distance) in the −X direction.

Similarly, the second surface 44*b* of the recess 44 is formed so as to be offset with respect to the central axis C1 of the first straight portion 41 by a predetermined amount (i.e., predetermined distance) in the −Y direction.

Figure 6:
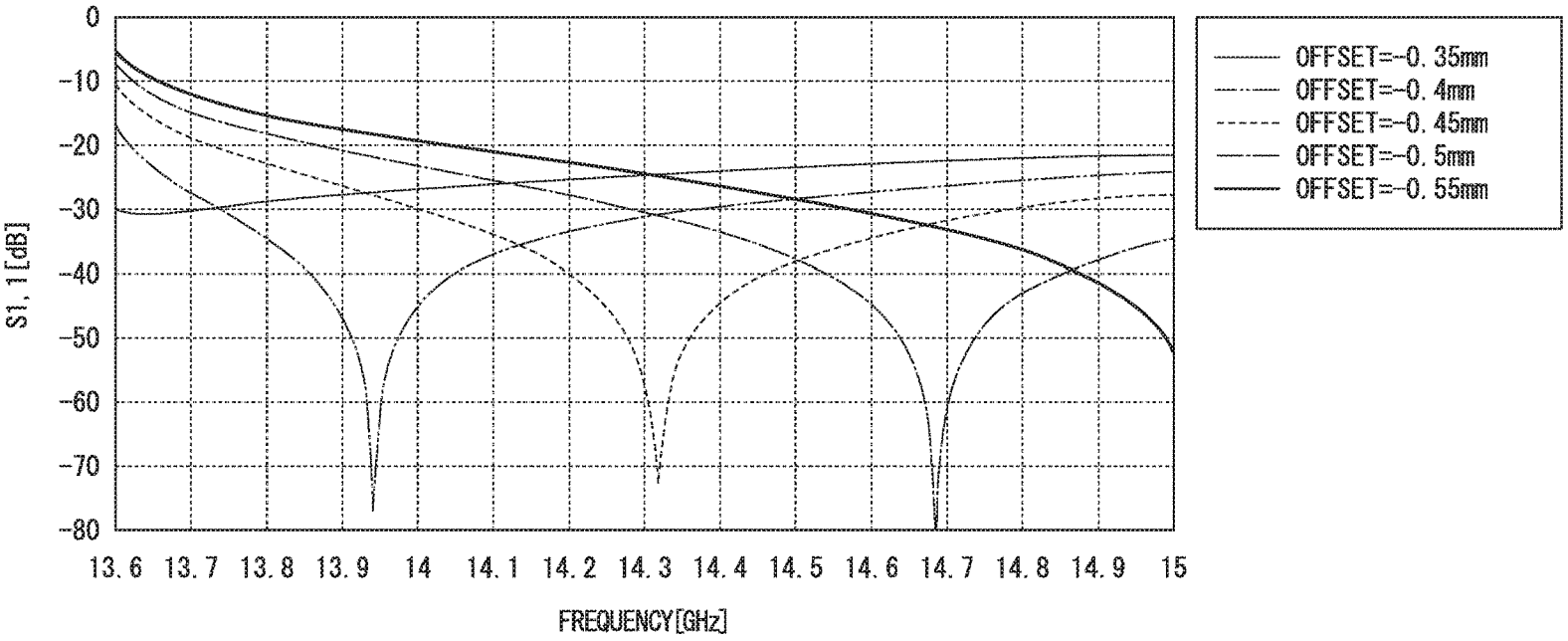
FIG. 6 is a graph showing reflection characteristics of the bend shown in FIG. 5.

FIG. 6 is a graph showing reflection characteristics (S11) in dB of the bend 43 in a case where the offset amount (the offset amount of the first surface 44*a* and the offset amount of the second surface 44*b*) is changed. For example, "offset =−0.35 mm" of FIG. 6 means a shape in which the first surface 44*a* of the recess 44 is offset with respect to the central axis C2 of the second straight portion 42 in the −X direction by 0.35 mm and the second surface 44*b* of the recess 44 is offset with respect to the central axis Cl of the first straight portion 41 by 0.35 mm in the −Y direction. The remaining offset amounts shown in FIG. 6 (−0.4 mm, −0.45 mm, −0.5 mm, and −0.55 mm) are defined in the same manner as in the above description made with respect to the "offset =−0.35 mm". The horizontal axis in FIG. 6 represents frequency (in GHz) of a radio wave.

As shown in FIG. 6, in the configuration in which the recess 44 is formed, it can be seen that a specific band (e.g., fractional bandwidth) in which S11 is equal to or less than a predetermined reference (for example, −20 dB or less) is secured 10% or more in various offset amounts, for example. That is, it can be seen that the offset amount is appropriately adjusted and set, and thus, the impedance mismatching at the bend 43 is reduced. Accordingly, reflection loss can be reduced.

Next, the opening sizes of the bend waveguide 32 will be described.

As shown in FIG. 4, the opening sizes (i.e., the opening sizes of the first straight portion 41 and the second straight portion 42) of the bend waveguide 32 are smaller than the opening sizes of the standard waveguides 31A and 31B. The "opening size" mentioned in the present disclosure means an opening size (in other words, an opening size in a cross section which substantially crosses the propagation direction of the radio wave) facing the propagation direction of the radio wave. The "opening size being large (or small)" means that a vertical width and a horizontal width that define the size of the opening in the cross section are respectively large (or respectively small).

For example, the opening size of the bend waveguide 32 is smaller than the opening sizes of the standard waveguides 31A and 31B, and thus, a low-frequency radio wave is hard to pass through the waveguide bend 1. Accordingly, it is possible to reduce an undesired wave or thermal noise other than the passband of the waveguide bend 1.

In a case where the waveguide bend 1 is manufactured by cutting (e.g., cutting off) the metal block 27, the opening size of the bend waveguide 32 is smaller than the opening sizes of the standard waveguides 31A and 31B, and thus, it is possible to reduce the processing time.

Next, a filter function of the bend waveguide 32 will be described.

The bend waveguide 32 is formed so as to have a narrow tube width, and thus, the bend waveguide 32 according to the present embodiment has a function of filtering a predetermined frequency band.

Specifically, an internal space of the bend waveguide 32 has a substantially rectangular sectional shape in a cross section in a direction which is substantially perpendicular to the propagation direction of the radio wave (see FIG. 5). The "substantially rectangular" mentioned in the present disclosure includes a rectangle having a rounded corner. The bend waveguide 32 has a tube width A as a width of the sectional shape of the internal space of the bend waveguide 32 in a longitudinal direction of the sectional shape. The tube width A is a width of a portion obtained by excluding the rounded corner from the sectional shape, the width extending in the longitudinal direction.

In a case where a frequency desired to be attenuated is f and light speed is c, the tube width A of the bend waveguide 32 is set so as to satisfy the relationship of the following expression (1).

$$f<c/2A \tag{1}$$

The "frequency desired to be attenuated" is a frequency lower than the passband set to the waveguide bend 1. That is, the "frequency desired to be attenuated" is a frequency lower than a cut-off frequency set to the waveguide bend 1. In other words, the tube width A of the bend waveguide 32 is narrow such that the cut-off frequency is higher than the frequency desired to be attenuated.

More specifically, if the cut-off frequency set to the bend waveguide 32 is fc, a wavelength of the radio wave in the cut-off frequency fc is λc, a frequency lower than the cut-off frequency is f, a wavelength of the radio wave in the frequency f is λ, a length of the bend waveguide 32 in the propagation direction of the radio wave is L1, a tube width of the sectional shape of the internal space of the bend waveguide 32 in the longitudinal direction of the sectional shape is A, a wave number is k, a wave number at the cut-off frequency is kc, and light speed is c, the attenuation amount of the radio wave of the frequency f can be expressed by the following expression (2). As shown in FIG. 5, the length L1 of the bend waveguide 32 is the sum of a length La between the end of the first straight portion 41 in the +X direction and the first surface 44*a* of the recess 44 and a length Lb between the end of the second straight portion 42 in the +Y direction and the second surface 44*b* of the recess 44.

$$\text{Attenuation amount } (f) = -10\log_{10}e^{-2\alpha L1} = 8.69\alpha L1 \tag{2}$$

$$\text{Cut-off frequency } f_c = \frac{c}{2A},\ k_c = \frac{2\pi}{\lambda_c} = \frac{2f_c\pi}{c},$$

-continued $$k = \frac{2\pi}{\lambda} = \frac{2f\pi}{c}$$

$$\text{Attenuation contant } \alpha = \sqrt{k_c^2 - k^2}$$

As described above, the tube width A and length L1 of the bend waveguide 32 are appropriately adjusted and set, and thus, the bend waveguide 32 has a desired cut-off frequency. Accordingly, it is possible to add a high-pass filter capable of attenuating the radio wave of the frequency band which is equal to or less than the cut-off frequency to the bend waveguide 32.

However, as mentioned above, in order to reduce the undesired wave or the thermal noise or improve manufacturability (e.g., processing time) or in order to add the function of filtering the predetermined frequency band, if the bend waveguide 32 is formed to have the opening size smaller than the opening sizes of the standard waveguides 31A and 31B, the impedance mismatching is caused between the bend waveguide 32 and the standard waveguides 31A and 31B. Thus, in the present embodiment, the matching waveguides 33A and 33B are provided between the bend waveguide 32 and the standard waveguides 31A and 31B, and the matching waveguides are adjusted such that impedance matching is performed between the bend waveguide 32 and the standard waveguides 31A and 31B.

Hereinafter, the matching waveguides 33A and 33B will be described in detail.

Each of the pair of matching waveguides 33A and 33B is an example of a "third waveguide". As shown in FIG. 4, the pair of matching waveguides 33A and 33B is provided so as to be divided on both sides of the bend waveguide 32 in the propagation direction of the radio wave. Hereinafter, for the sake of convenience in the description, one matching waveguide 33A is referred to as a "first matching waveguide 33A", and the other matching waveguide 33B is referred to as a "second matching waveguide 33B".

The first matching waveguide 33A is provided between the first standard waveguide 31A and the first straight portion 41 of the bend waveguide 32. The first matching waveguide 33A extends along the +X direction. The first matching waveguide 33A connects the first standard waveguide 31A and the bend waveguide 32.

The opening size of the first matching waveguide 33A is smaller than the opening size of the first standard waveguide 31A, and is larger than the opening size (e.g., the opening size of the first straight portion 41) of the bend waveguide 32. The opening dimension (that is, the vertical width and the horizontal width of the opening) of the first matching waveguide 33A and the length L2 of the first matching waveguide 33A in the propagation direction of the radio wave are adjusted and set, and thus, the first matching waveguide 33A achieves the impedance matching between the first standard waveguide 31A and the bend waveguide 32.

For example, if the guide-wavelength in the first matching waveguide 33A, which is a guide-wavelength of the radio wave in a minimum frequency of the passband set to the waveguide bend 1 is λg, the length L2 of the first matching waveguide 33A in the propagation direction of the radio wave is set so as to satisfy the relationship of the following expression (3).

$$0 < L2 < \frac{\lambda_g}{2} \tag{3}$$

More specifically, an internal space of the first matching waveguide 33A has a substantially rectangular sectional shape in a cross section in a direction which is substantially perpendicular to the propagation direction of the radio wave. The first matching waveguide 33A has a tube width a as a width of the sectional shape in a longitudinal direction of the sectional shape (see FIG. 5). The tube width a is a width of a portion obtained by excluding a rounded corner from the sectional shape, the width extending in the longitudinal direction.

The first matching waveguide 33A has a cut-off frequency determined by the sectional shape of the first matching waveguide 33A.

If a wavelength of the radio wave in the cut-off frequency of the first matching waveguide 33A is λc, the tube width of the first matching waveguide 33A is a, and a wavelength of the radio wave in the minimum frequency in the passband set to the waveguide bend 1 is λ, the guide-wavelength λg can be calculated as the following expression (4).

$$\lambda_c = 2a \tag{4}$$

$$\lambda_g = \frac{\lambda}{\sqrt{1 - \left(\frac{\lambda}{\lambda_c}\right)^2}}$$

In a transmission line to which a load of $Z_L$ is connected, an impedance $Z_{in}$ viewed from a position of a distance L from the load is expressed as the following expression (5). $Z_0$ is a characteristic impedance of the transmission line.

$$Z_{in} = Z_0 \frac{Z_L \cos(\beta L) + Z_0 j \sin(\beta L)}{Z_0 \cos(\beta L) + Z_L j \sin(\beta L)}, \ \beta = \frac{2\pi}{\lambda_g} \tag{5}$$

Here, in a case where L=λg/2, βL=π, and $Z_{in}=Z_L$.

That is, an input impedance $Z_{in}$ is changed at a cycle of λg/2 which is the length of L. In other words, the length L2 of the first matching waveguide 33A is set to be in a range of the expression (3), and thus, an adjustable impedance range can be included.

For example, in a case where characteristic impedances of the first standard waveguide 31A, the bend waveguide 32 and the first matching waveguide 33A are respectively Z1, Z2 and Z3, the opening size (i.e., the vertical width and the horizontal width of the opening) of the first matching waveguide 33A may be set such that the characteristic impedance Z3 of the first matching waveguide 33A satisfies the following expression (6).

$$Z3 = \sqrt{Z1 \times Z2} \tag{6}$$

In this case, the first matching waveguide 33A operates as a λ/4 transformer, and thus, it is possible to achieve impedance matching at a value at which the length L2 of the first matching waveguide 33A approximates λg/4. However, the λg mentioned herein is a guide-wavelength in a center frequency of the passband set to the waveguide bend 1.

If the first matching waveguide 33A has such a length, it may be possible to effectively adjust the impedance between the first standard waveguide 31A and the bend waveguide 32.

Similarly, as shown in FIG. 4, the second matching waveguide 33B is provided between the second standard waveguide 31B and the second straight portion 42 of the bend waveguide 32. The second matching waveguide 33B extends along the +Y direction. The second matching waveguide 33B connects the second standard waveguide 31B and the bend waveguide 32.

The opening size of the second matching waveguide 33B is smaller than the opening size of the second standard waveguide 31B, and is larger than the opening size (e.g., the opening size of the second straight portion 42) of the bend waveguide 32.

The opening dimension (i.e., the vertical width and the horizontal width of the opening) of the second matching waveguide 33B and the length L3 of the second matching waveguide 33B in the propagation direction of the radio wave are adjusted and set, and thus, the second matching waveguide 33B achieves the impedance matching between the second standard waveguide 31B and the bend waveguide 32.

For example, similarly to the length L2 of the first matching waveguide 33A, the length L3 of the second matching waveguide 33B can be set based on the above expression (3). The length L2 of the first matching waveguide 33A and the length L3 of the second matching waveguide 33B may be the same, or may be different from each other. The opening size of the first matching waveguide 33A and the opening size of the second matching waveguide 33B may be the same, or may be different from each other.

Figure 7:
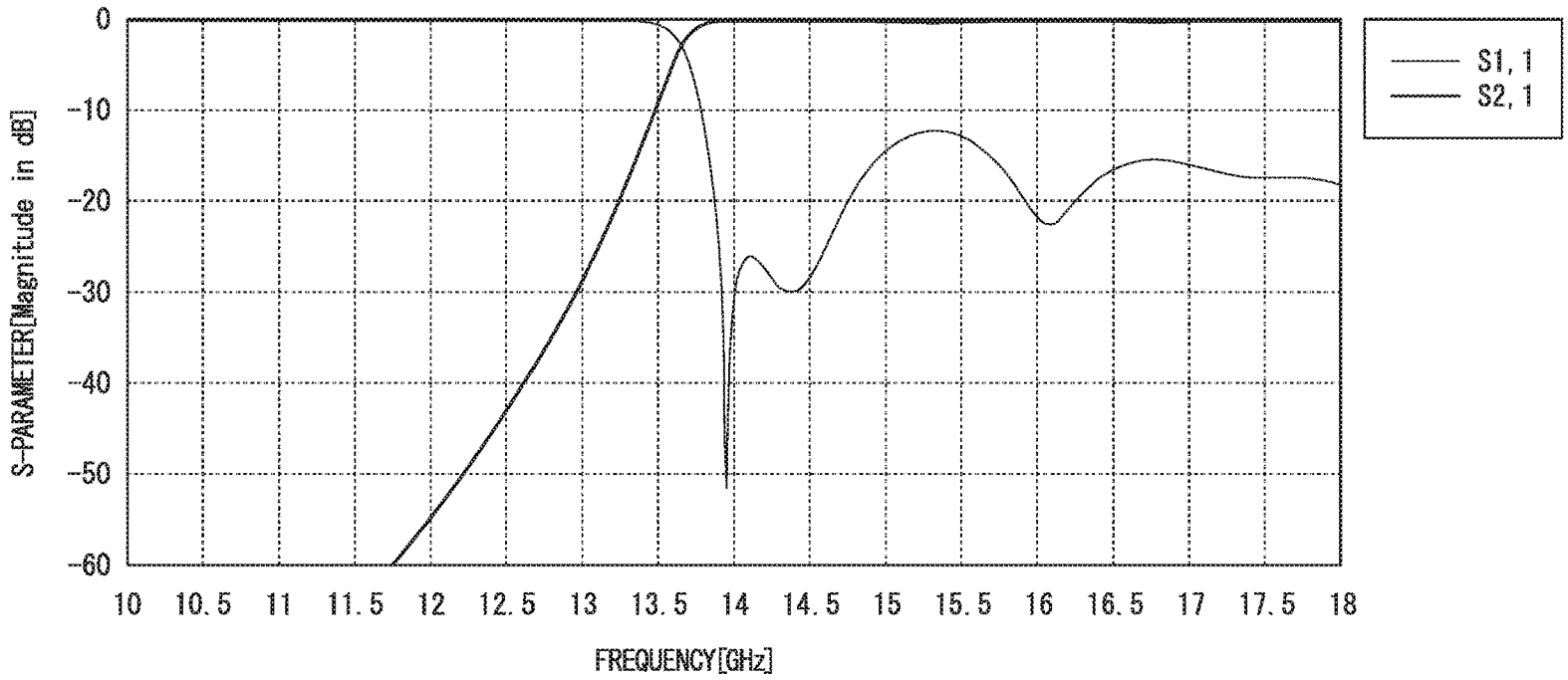
FIG. 7 is a graph showing reflection characteristics and pass characteristics of the waveguide bend shown in FIG. 4.

FIG. 7 is a graph showing an example of reflection characteristics (S11) and pass characteristics (S21) of the waveguide bend 1 in a case where the filter function is added to the bend waveguide 32 and the matching waveguides 33A and 33B are provided. The horizontal axis in FIG. 7 represents frequency (in GHz) of a radio wave.

As shown in FIG. 7, in the line of S21, it can be seen that the pass characteristics are favorable in the high frequency band of about more than 14 GHz and the radio wave is attenuated in the low frequency band of about 13 GHz or less. That is, it can be seen that a high-pass filter is appropriately realized by the bend waveguide 32. In the line of S11, it can be seen that S11 is equal to or less than a predetermined reference (e.g., −20 dB or less) in the frequency band from about 14 GHz to 14.5 GHz. That is, it can be seen that the matching waveguides 33A and 33B are provided, and thus, it is possible to achieve the impedance matching between the bend waveguide 32 and the standard waveguides 31A and 31B.

The pair of standard waveguides 31A and 31B, the bend waveguide 32 and the pair of matching waveguides 33A and 33B, which are described above, are integrally formed with the metal block 27. For example, the pair of standard waveguides 31A and 31B, the bend waveguide 32, and the pair of matching waveguides 33A and 33B are formed by cutting (e.g., cutting off) the metal block 27 in two directions. For example, the machining of the waveguide bend 1 is combined with the machining of the housing case 15, and is performed as a part of the machining of the housing case 15. For example, the machining of at least a part of the waveguide bend 1 is performed continuously with the machining of the storage 11*a* of the housing case 15. The machining of the waveguide bend 1 is not limited to cutting, and the waveguide bend may be manufactured through electric discharging, die casting, or casting.

Here, in a case where the waveguide bend 1 is manufactured by cutting (e.g., cutting oft) the metal block 27, the corners of the opening shape in the waveguide bend 1 are rounded due to manufacturing limitations (e.g., a minimum radius of a use tool). Even in a case where the waveguide bend 1 is manufactured through die casting or casting, in order to secure detachability of a product from a mold, the corners of the opening shape in the waveguide bend 1 are rounded. Even in a case where the waveguide bend 1 is manufactured through electric discharging, the corners of the opening shape in the waveguide bend 1 are rounded in order to easily manufacture the waveguide bend 1.

Hereinafter, the shape of the corner of the opening shape will be described in conjunction with the waveguide bend 1 manufactured through end milling as an example of the waveguide bend 1. In the present embodiment, four corners of each waveguide have round shapes depending on cut depths.

More specifically, as shown in FIG. 4, the standard waveguides 31A and 31B, the bend waveguide 32 and the matching waveguides 33A and 33B have a substantially rectangular sectional shape including arc-shaped corners in a cross section in a direction which is substantially perpendicular to the propagation direction of the radio wave. That is, the sectional shapes of the standard waveguides 31A and 31B include four corners 51*a* and 51*b*, respectively. Similarly, the sectional shapes of the straight portions 41 and 42 of the bend waveguide 32 include four corners 52*a* and 52*b*, respectively. The sectional shapes of the matching waveguides 33A and 33B include four corners 53*a* and 53*b*, respectively.

Here, it is necessary to use an end mill having a larger diameter as the cut depth from the end surface of the metal block 27 becomes deeper. In general, a diameter ϕ of an end mill necessary for a cut depth D can be expressed by the following expression (7).

$$\phi \geq D/7 \tag{7}$$

Thus, the radius of curvature R of the corner of each waveguide is set so as to satisfy the following expression (8).

$$R \geq \phi/2 \tag{8}$$

Accordingly, as shown in FIG. 4, in a case where the cut depths of the first standard waveguide 31A, the first surface 44*a* of the bend waveguide 32 and first matching waveguide 33A are respectively D1*a*, D2*a* and D3*a*, the radii of curvature of the corners 51*a*, 52*a* and 53*a* of the first standard waveguide 31A, the first straight portion 41 of the bend waveguide 32 and the first matching waveguide 33A are respectively R1*a*, R2*a* and R3*a*, and the diameters of the end mills that machine the first standard waveguide 31A, the first straight portion 41 of the bend waveguide 32 and the first matching waveguide 33A are respectively ϕ1*a*, ϕ2*a* and ϕ3*a*, the following expression (9) is satisfied.

$$R1a \geq \phi 1a/2 \geq D1a/14$$

$$R2a \geq \phi 2a/2 \geq D2a/14$$

$$R3a \geq \phi 3a/2 \geq D3a/14 \tag{9}$$

Similarly, in a case where the cut depths of the second standard waveguide 31B, the second surface 44*b* of the bend waveguide 32 and the second matching waveguide 33B are respectively D1*b*, D2*b* and D3*b*, the radii of curvature of the corners 51*b*, 52*b* and 53*b* of the second standard waveguide 31B, the second straight portion 42 of the bend waveguide 32 and the second matching waveguide 33B are respectively R1*b*, R2*b* and R3*b* and the diameters of the end mills that machine the second standard waveguide 31B, the second straight portion 42 of the bend waveguide 32 and the second matching waveguide 33B are respectively ϕ1*b*, ϕ2*b* and ϕ3*b*, the following expression (10) is satisfied.

$$R1b \geq \phi 1b/2 \geq D1b/14$$

$$R2b \geq \phi 2b/2 \geq D2b/14$$

$$R3b \geq \phi 3b/2 \geq D3b/14 \quad (10)$$

For example, due to the above-described reason, the radius of curvature of the corner 53*a* of the first matching waveguide 33A is smaller than the radius of curvature of the corner 52*a* of the first straight portion 41 of the bend waveguide 32. The radius of curvature of the corner 51*a* of the first standard waveguide 31A is smaller than the radius of curvature of the corner 52*a* of the first straight portion 41 of the bend waveguide 32 and the radius of curvature of the corner 53*a* of the first matching waveguide 33A. In all the corners 51*a*, 52*a* and 53*a*, the radius of curvature is equal to or greater than, for example, 0.05 mm.

Similarly, the radius of curvature of the corner 53*b* of the second matching waveguide 33B is smaller than the radius of curvature of the corner 52*b* of the second straight portion 42 of the bend waveguide 32. The radius of curvature of the corner 51*b* of the second standard waveguide 31B is smaller than the radius of curvature of the corner 52*b* of the second straight portion 42 of the bend waveguide 32 and the radius of curvature of the corner 53*b* of the second matching waveguide 33B. In all the corners 51*b*, 52*b* and 53*b*, the radius of curvature is equal to or greater than, for example, 0.05 mm.

As stated above, if the corners 51*a* and 51*b* of the standard waveguides 31A and 31B and the corners 52*a* and 52*b* of the bend waveguide 32 are formed in arc shapes having different radii of curvature, the impedance mismatching is easily caused between the bend waveguide 32 and the standard waveguides 31A and 31B. However, in the present embodiment, the matching waveguides 33A and 33B are provided between the bend waveguide 32 and the standard waveguides 31A and 31B, and thus, the impedance matching is achieved between the bend waveguide 32 and the standard waveguides 31A and 31B.

That is, in the present embodiment, even in a case where the impedance mismatching is caused based on a difference between the shapes of the corners of the first standard waveguide 31A and the bend waveguide 32, the opening dimension (i.e., the vertical width and the horizontal width of the opening) of the first matching waveguide 33A and the length L2 of the first matching waveguide 33A in the propagation direction of the radio wave are appropriately adjusted and set, and thus, the impedance matching is achieved between the first standard waveguide 31A and the bend waveguide 32.

Similarly, even in a case where the impedance mismatching is caused based on a difference between the shapes of the corners of the second standard waveguide 31B and the bend waveguide 32, the opening dimension (i.e., the vertical width and the horizontal width of the opening) of the second matching waveguide 33B and the length L3 of the second matching waveguide 33B in the propagation direction of the radio wave are appropriately adjusted and set, and thus, the impedance matching is achieved between the second standard waveguide 31B and the bend waveguide 32.

With such a configuration, it is possible to improve the manufacturability, and it is possible to provide the waveguide bend 1 and the wireless device 2 capable of easily achieving the impedance matching.

Here, for the purposes of comparison, it is considered that a waveguide bend is manufactured by respectively cutting a plurality of metal blocks and bonding or coupling two metal blocks through brazing or screw clamping. Initially, in a case where the plurality of metal blocks is bonded through brazing, since it is necessary to heat all the metal blocks, it takes time to perform the bonding operation in some cases. In a case where the plurality of metal blocks is coupled with screws, the radio wave leaks or contact resistance is increased on coupling surfaces of the metal blocks, and thus, it is easy to increase a pass loss. In a case where the waveguide bend is manufactured separately from the housing case of the wireless device and is attached to the housing case, the cost or size of the device is easily increased.

Meanwhile, if the waveguide bend is manufactured using one metal block, since the corners of the opening shapes are rounded due to the manufacturing limitations, the impedance mismatching is easily caused within the waveguide bend. If the tube width of a part of the waveguide bend is formed so as to be narrow in order to reduce the undesired wave, to reduce thermal noise, or achieve another purpose, the impedance mismatching may be easily achieved.

Thus, the waveguide bend 1 according to the present embodiment includes the metal block 27 in which the standard waveguides 31A and 31B, the bend waveguide 32 and the matching waveguides 33A and 33B are integrally formed. The bend waveguide 32 includes the bend 43 which changes the propagation direction of the radio wave, and the opening size of the bend waveguide 32 is smaller than those of the standard waveguides 31A and 31B. The matching waveguides 33A and 33B are provided between the standard waveguides 31A and 31B and the bend waveguide 32, and the opening sizes of the matching waveguides 33A and 33B are smaller than those of the standard waveguides 31A and 31B and are larger than that of the bend waveguide 32.

Initially, the waveguide bend 1 having such a configuration has various advantages than the waveguide bend manufactured by combining the plurality of metal blocks. For example, unlike the case where the plurality of metal blocks is bonded through brazing, since it does not take time to heat the metal block, an assembling operation is not likely to be complicated, and the manufacturability is improved. Unlike the case where the plurality of metal block is coupled with screws, since the radio wave does not leak or the contact resistance is not increased on the coupling surfaces of the metal blocks, the pass characteristics are improved. Since it is not necessary to provide a choke structure as a countermeasure for a leakage of the radio wave, it is possible to reduce the size and cost of the waveguide bend 1.

According to the present embodiment, the matching waveguides 33A and 33B are provided between the standard waveguides 31A and 31B and the bend waveguide 32. Thus, even in a case where the impedance mismatching is caused between the standard waveguides 31A and 31B and the bend waveguide 32 due to various reasons, it is possible to reduce the impedance mismatching by the matching waveguides 33A and 33B. Accordingly, it is possible to improve the pass characteristics of the waveguide bend 1.

The opening sizes of the matching waveguides 33A and 33B are smaller than the opening sizes of the standard waveguides 31A and 31B, and are larger than the opening size of the bend waveguide 32. According to such matching waveguides 33A and 33B, even in a case where the waveguide bend 1 is manufactured by performing cutting, electric discharging, die casting, or casting on one metal block 27, it is possible to easily provide the matching waveguides 33A and 33B between the standard waveguides 31A and 31B and the bend waveguide 32. Therefore, it is possible to improve the manufacturability of the waveguide bend 1.

Since the bend waveguide 32 is positioned in a relatively deep portion from the end surface of the metal block 27, the radii of curvature of the arc-shaped corners 52*a* and 52*b* of the bend waveguide 32 easily becomes larger due to the manufacturing limitations in some cases. In such a case, the impedance mismatching is easily caused between the standard waveguides 31A and 31B and the bend waveguide 32 based on a difference between the radii of curvature of the arc-shaped corners 51*a* and 51*b* of the standard waveguides 31A and 31B and the radii of curvature of the arc-shaped corners 52*a* and 52*b* of the bend waveguide 32.

However, in the present embodiment, the matching waveguides 33A and 33B are provided between the standard waveguides 31A and 31B and the bend waveguide 32. Accordingly, even in a case where the corners 51*a*. 51*b*, 52*a* and 52*b* of the respective waveguides 31A, 31B and 32 have the corners of which the radii of curvature are different, it is possible to reduce the impedance mismatching.

In the present embodiment, the standard waveguides 31A and 31B and the matching waveguides 33A and 33B are respectively provided on each of both sides of the bend waveguide 32 in the propagation direction of the radio wave.

With such a configuration, it is possible to reduce the impedance mismatching on both sides of the bend waveguide 32 in the propagation direction of the radio wave. Therefore, it is possible to further improve the pass characteristics of the waveguide bend 1.

In the present embodiment, the tube width A of the bend waveguide 32 is set so as to satisfy the above expression (1). That is, the bend waveguide 32 according to the present embodiment has the function of filtering the predetermined frequency band. In other words, the opening size of the bend waveguide 32 having such a filter function is relatively smaller than the opening sizes of the standard waveguides 31A and 31B. Thus, relatively high impedance mismatching is caused between the standard waveguides 31A and 31B and the bend waveguide 32.

However, in the present embodiment, the opening sizes and lengths of the matching waveguides 33A and 33B are adjusted and set, and thus, the impedance mismatching between the standard waveguides 31A and 31B and the bend waveguide 32 is reduced. In other words, the matching waveguides 33A and 33B are provided, and thus, it is possible to add the filter function to the bend waveguide 32 while achieving the impedance matching. With such a configuration, it is possible to further reduce the size and cost of the wireless device 2 than in a case where a filter is provided as a separate component.

In the present embodiment, the lengths L2 and L3 of the matching waveguides 33A and 33B in the propagation direction of the radio wave are set based on the above expression (3).

With such a configuration, it may be possible to effectively reduce the impedance mismatching between the standard waveguides 31A and 31B and the bend waveguide 32.

In the present embodiment, the radii of curvature of the corners 53*a* and 53*b* of the matching waveguides 33A and 33B are smaller than the radii of curvature of the corners 52*a* and 52*b* of the bend waveguide 32.

With such a configuration, it is possible to machine the bend waveguide 32 and the matching waveguides 33A and 33B by an appropriate machining tool corresponding to the cut depth. The radii of curvature of the corners 53*a* and 53*b* of the matching waveguides 33A and 33B are smaller than the radii of curvature of the corners 52*a* and 52*b* of the bend waveguide 32, and thus, it is possible to improve the degrees of freedom in the design of the opening shapes of the matching waveguides 33A and 33B. If it is possible to improve the degrees of freedom in the design of the opening shapes of the matching waveguides 33A and 33B, it may be possible to effectively reduce the impedance mismatching between the standard waveguides 31A and 31B and the bend waveguide 32.

In the present embodiment, the waveguide bend 1 is directly provided at the metal block 27 forming at least a part of the housing 11. For example, the metal block 27 is a member forming the housing case 15.

With such a configuration, since it is possible to collectively perform the machining of the waveguide bend 1 and the machining of the housing 11, it is possible to further improve the manufacturability. Accordingly, it is possible to reduce the cost of the waveguide bend 1 and the wireless device 2.

(Second Embodiment)

Next, a waveguide bend 1 according to a second embodiment will be described.

Figure 8:
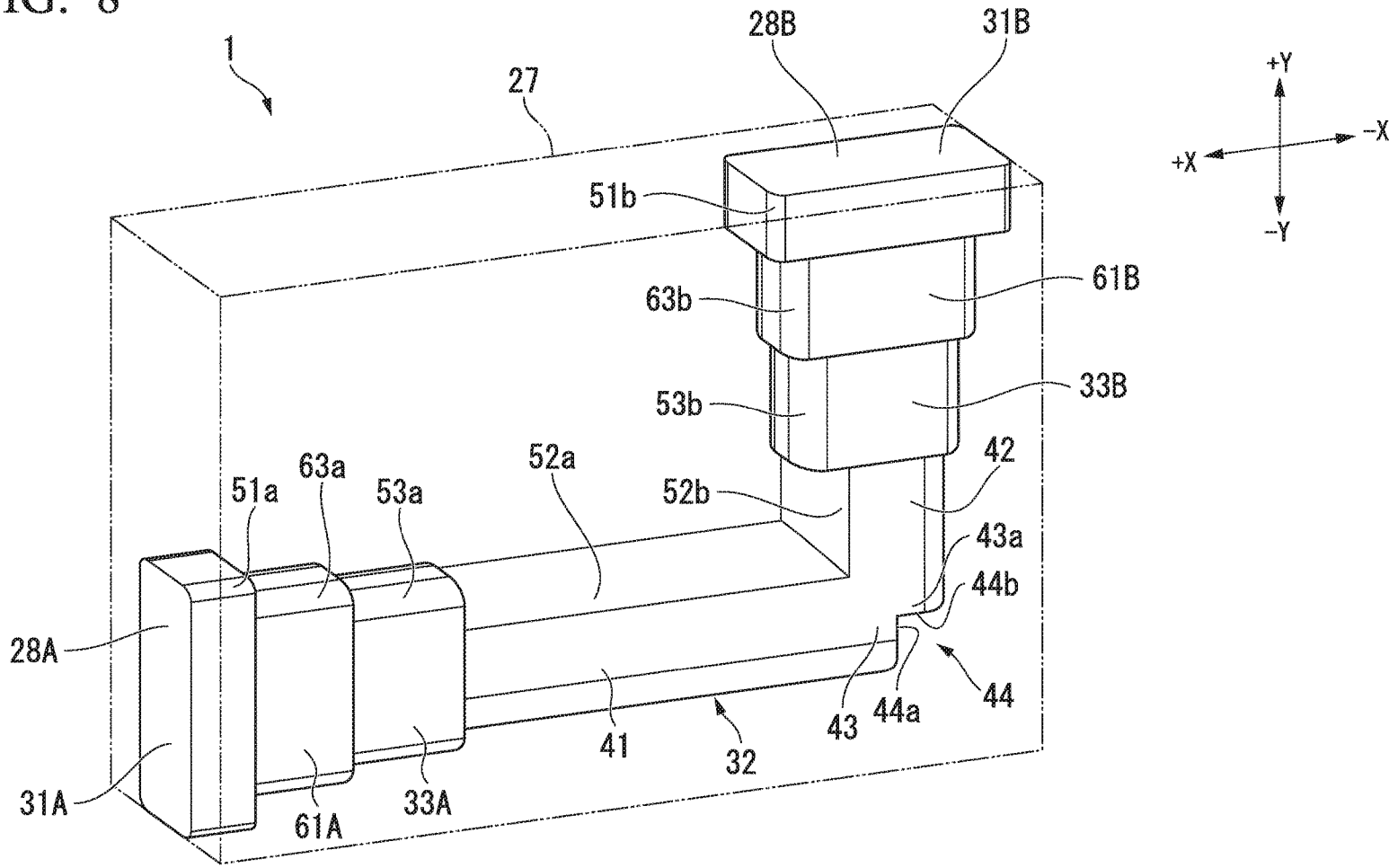
FIG. 8 is a perspective view showing a waveguide bend according to a second embodiment.

FIG. 8 shows the waveguide bend 1 according to the second embodiment. The present embodiment is different from the first embodiment in that the waveguide bend 1 includes matching waveguides in multiple stages. Another configuration of the present embodiment is the same as that in the first embodiment.

As shown in FIG. 8, the waveguide bend 1 according to the present embodiment includes a third matching waveguide 61A between the first standard waveguide 31A and the first matching waveguide 33A. The third matching waveguide 61A is an example of a "fourth waveguide". The opening size of the third matching waveguide 61A is smaller than the opening size of the first standard waveguide 31A, and is larger than the opening size of the first matching waveguide 33A. In the present embodiment, the opening dimensions of the first matching waveguide 33A and the third matching waveguide 61A and the lengths thereof in the propagation direction of the radio wave are adjusted, and thus, the impedance mismatching between the first standard waveguide 31A and the bend waveguide 32 is reduced.

Similarly, the waveguide bend 1 according to the present embodiment includes a fourth matching waveguide 61B between the second standard waveguide 31B and the second matching waveguide 33B. The fourth matching waveguide 61B is another example of the "fourth waveguide". The opening size of the fourth matching waveguide 61B is smaller than the opening size of the second standard waveguide 31B, and is larger than the opening size of the second matching waveguide 33B. In the present embodiment, the opening dimensions of the second matching waveguide 33B and the fourth matching waveguide 61B and the lengths thereof in the propagation direction of the radio wave are adjusted, and thus, the impedance mismatching between the second standard waveguide 31B and the bend waveguide 32 is reduced.

Similarly to the matching waveguides 33A and 33B, the internal spaces of the matching waveguides 61A and 61B have substantially rectangular sectional shapes including arc-shaped corners 63*a* and 63*b* in a cross section along a direction which is substantially perpendicular to the propagation direction of the radio wave.

The radius of curvature of the corner 63*a* of the third matching waveguide 61A is larger than the radius of curvature of the corner 51*a* of the first standard waveguide 31A, and is smaller than the radius of curvature of the corner 53*a* of the first matching waveguide 33A. Similarly, the radius of curvature of the corner 63*b* of the fourth matching waveguide 61B is larger than the radius of curvature of the corner

51*b* of the second standard waveguide 31B, and is smaller than the radius of curvature of the corner 53*b* of the second matching waveguide 33B.

With such a configuration, it is possible to increase the band of the impedance matching by using the matching waveguides 33A, 33B, 61A and 61B in multiple stages. Thus, it is possible to further improve the pass characteristics of the waveguide bend 1. The matching waveguides in multiple stages are not limited to the two stages, and may be provided in multiple stages of 3 stages or more.

In the propagation direction of the radio wave, the length of the third matching waveguide 61A and the length of the fourth matching waveguide 61B may be the same, or may be different. The opening size of the third matching waveguide 61A and the opening size of the fourth matching waveguide 61B may be the same, or may be different.

Figure 9:
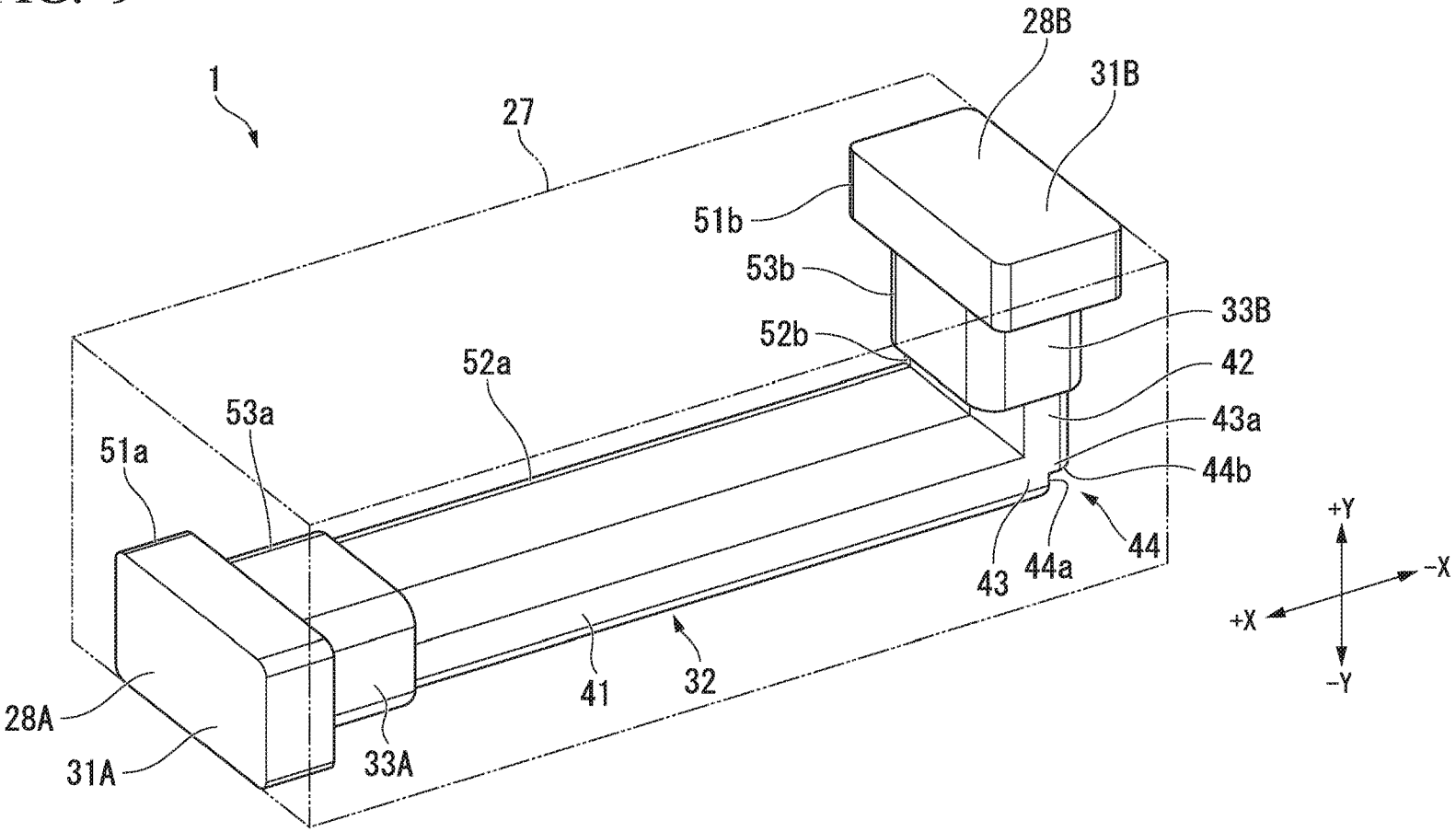
FIG. 9 is a perspective view showing a modification example of the waveguide bend according to the embodiments.

The waveguide bends 1 according to the first and second embodiments have been described. However, the waveguide bends 1 according to the embodiments are not limited to the above-described examples. For example, in the first and second embodiments, the waveguide bends 1 bent in an H surface (i.e., magnetic-field surface) direction have been described. As shown in FIG. 9, the waveguide bend 1 according to the first embodiment may be a waveguide bend bent in an E surface (i.e., electric-field surface) direction. The same is true of the case where the matching waveguides in multiple stages shown in the second embodiment are used.

In the above-described embodiments, the central axes (e.g., tube axes) of the first standard waveguide 31A, the first matching waveguide 33A and the first straight portion 41 of the bend waveguide 32 are substantially aligned to one another. In addition, the central axes (e.g., tube axes) of the first standard waveguide 31A, the first matching waveguide 33A and the first straight portion 41 of the bend waveguide 32 may be deviated from one another within a range in which machinability is not greatly degraded. The same is true of the central axes (e.g., tube axes) of the second standard waveguide 31B, the second matching waveguide 33B and the second straight portion 42 of the bend waveguide 32.

The bend waveguides 32 of the waveguide bends 1 according to the first and second embodiments have the function of filtering the predetermined frequency band. However, the waveguide bend 1 may not have such a filter function.

According to at least one embodiment described above, the waveguide bend 1 includes the metal block 27 in which the standard waveguides 31A and 31B, the bend waveguide 32, and the matching waveguides 33A and 336 are integrally formed. The bend waveguide 32 includes the bend 43 which changes the propagation direction of the radio wave, and the opening size of bend waveguide 32 is smaller than the opening sizes of the standard waveguides 31A and 31B. The matching waveguides 33A and 33B are provided between the standard waveguides 31A and 31B and the bend waveguide 32, and the opening sizes of the matching waveguides 33A and 33B are smaller than the opening sizes of the standard waveguides 31A and 31B, and are larger than the opening size of the bend waveguide 32. With such a configuration, it is possible to improve the manufacturability of the waveguide bend 1 and to provide the waveguide bend 1 capable of easily achieving the impedance matching.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A waveguide bend comprising:

a metal block forming at least a part of a housing which accommodates a board unit, the board unit comprising a circuit configured to supply a radio wave to the waveguide bend, the metal block comprising a mounting surface, a first waveguide, a second waveguide, and a third waveguide, and the mounting surface, the first waveguide, the second waveguide, and the third waveguide being integrally formed, wherein:

the mounting surface is configured to support the board unit that is mounted on the mounting surface, the second waveguide comprises a first straight portion, a second straight portion, and a bend, the second straight portion extends in a direction different from the first straight portion, the bend is provided between the first straight portion and the second straight portion and changes a propagation direction of the radio wave, and an opening size of the second waveguide is smaller than an opening size of the first waveguide, the third waveguide is provided between the first waveguide and the second straight portion of the second waveguide, and an opening size of the third waveguide is smaller than the opening size of the first waveguide and is larger than the opening size of the second waveguide, the first waveguide, the third waveguide, and the second straight portion of the second waveguide extend in a direction substantially perpendicular to the mounting surface and are arranged in a straight line in this order in the metal block, an internal space of the second waveguide has a substantially rectangular sectional shape in a cross section in a direction which is substantially perpendicular to the propagation direction of the radio wave, and in a case where: a frequency which is lower than a passband set to the waveguide bend is f; a width of the sectional shape of the internal space of the second waveguide in a longitudinal direction of the sectional shape is A; and light speed is c, the following relational expression is satisfied $$f<c/2A.$$

2. The waveguide bend according to claim 1, wherein:

the metal block comprises a pair of first waveguides and a pair of third waveguides, the pair of first waveguides includes the first waveguide, and the pair of third waveguides includes the third waveguide, each of the pair of first waveguides is provided at a respective one of ends of the second waveguide in the propagation direction of the radio wave, and each of the pair of third waveguides is provided at a respective one of the ends of the second waveguide in the propagation direction of the radio wave.

3. The waveguide bend according to claim 1, wherein the metal block comprises a fourth waveguide between the first waveguide and the third waveguide, an opening size of the fourth waveguide is smaller than the opening size of the first waveguide and is larger than the opening size of the third waveguide.

4. The waveguide bend according to claim 1, wherein the first waveguide, the third waveguide, and the second straight portion of the second waveguide are formed by cutting the first waveguide, the third waveguide, and the second straight portion of the second waveguide out of one metal block as the metal block.

5. The waveguide bend according to claim 1, wherein in a case where: a guide-wavelength in the third waveguide, which is a guide-wavelength of a radio wave having a minimum frequency in a passband set to the waveguide bend, is λg; and a length of the third waveguide in the propagation direction of the radio wave is L, the following relational expression is satisfied $$0 < L < \frac{\lambda_g}{2}.$$

6. The waveguide bend according to claim 1, wherein:

the sectional shape of the internal space of the second waveguide includes a rounded corner, an internal space of the third waveguide has a substantially rectangular sectional shape in a cross section in the direction which is substantially perpendicular to the propagation direction of the radio wave, and the sectional shape of the internal space of the third waveguide includes a rounded corner, and a radius of curvature of the rounded corner of the internal space of the third waveguide is smaller than a radius of curvature of the rounded corner of the internal space of the second waveguide.

7. The waveguide bend according to claim 1, wherein the metal block is one metal block and is not formed from a plurality of combined metal blocks.

8. The waveguide bend according to claim 7, wherein the first waveguide, the third waveguide, and the second straight portion of the second waveguide are formed by cutting the first waveguide, the third waveguide, and the second straight portion of the second waveguide out of the one metal block.

9. A wireless device comprising:

a waveguide bend comprising a metal block, the metal block forming at least a part of a housing and comprising a mounting surface, a first waveguide, a second waveguide, and a third waveguide, and the mounting surface, the first waveguide, the second waveguide, and the third waveguide being integrally formed; and a board unit provided in the housing, the board unit being mounted on the mounting surface, and the board unit comprising a circuit configured to supply a radio wave to the waveguide bend, wherein:

the second waveguide comprises a first straight portion, a second straight portion, and a bend, the second straight portion extends in a direction different from the first straight portion, the bend is provided between the first straight portion and the second straight portion and changes a propagation direction of the radio wave, and an opening size of the second waveguide is smaller than an opening size of the first waveguide, the third waveguide is provided between the first waveguide and the second straight portion of the second waveguide, and an opening size of the third waveguide is smaller than the opening size of the first waveguide and is larger than the opening size of the second waveguide, the first waveguide, the third waveguide, and the second straight portion of the second waveguide extend in a direction substantially perpendicular to the mounting surface and are arranged in a straight line in this order in the metal block, an internal space of the second waveguide has a substantially rectangular sectional shape in a cross section in a direction which is substantially perpendicular to the propagation direction of the radio wave, and in a case where: a frequency which is lower than a passband set to the waveguide bend is f; a width of the sectional shape of the internal space of the second waveguide in a longitudinal direction of the sectional shape is A; and light speed is c, the following relational expression is satisfied $$f<c/2A.$$

10. The wireless device according to claim 9, wherein the metal block comprises a fourth waveguide between the first waveguide and the third waveguide, an opening size of the fourth waveguide is smaller than the opening size of the first waveguide and is larger than the opening size of the third waveguide.

11. The wireless device according to claim 9 wherein:

the metal block comprises a pair of first waveguides and a pair of third waveguides, the pair of first waveguides includes the first waveguide, and the pair of third waveguides includes the third waveguide, each of the pair of first waveguides is provided at a respective one of ends of the second waveguide in the propagation direction of the radio wave, and each of the pair of third waveguides is provided at a respective one of the ends of the second waveguide in the propagation direction of the radio wave.

12. The wireless device according to claim 9, wherein in a case where: a guide-wavelength in the third waveguide, which is a guide-wavelength of a radio wave having a minimum frequency in a passband set to the waveguide bend, is λg; and a length of the third waveguide in the propagation direction of the radio wave is L, the following relational expression is satisfied $$0 < L < \frac{\lambda_g}{2}.$$

13. The wireless device according to claim 9, wherein the sectional shape of the internal space of the second waveguide includes a rounded corner, an internal space of the third waveguide has a substantially rectangular sectional shape in a cross section in the direction which is substantially perpendicular to the propagation direction of the radio wave, and the sectional shape of the internal space of the third waveguide includes a rounded corner, and a radius of curvature of the rounded corner of the internal space of the third waveguide is smaller than a radius of curvature of the rounded corner of the internal space of the second waveguide.

* * * * *